US005912445A

United States Patent [19]

Takedomi

[11] Patent Number: 5,912,445

[45] Date of Patent: Jun. 15, 1999

[54] MINIATURE PUSHBUTTON SWITCH WITH COIL SPRING CONTACT

[75] Inventor: Yasunari Takedomi, Hisai, Japan

[73] Assignee: Matsushita Electric Works, Ltd., Osaka, Japan

[21] Appl. No.: 08/964,320

[22] Filed: Nov. 4, 1997

[30] Foreign Application Priority Data

Nov. 8, 1996 [JP] Japan ..... 8-296164
May 15, 1997 [JP] Japan ..... 9-126067

[51] Int. Cl.[6] ..... H01H 13/28; H01H 13/52; H01H 1/06

[52] U.S. Cl. ..... 200/276.1; 200/61.82; 200/534

[58] Field of Search ..... 200/61.62–61.83, 200/276, 276.1, 520–535

[56] References Cited

U.S. PATENT DOCUMENTS

| | | | |
|---|---|---|---|
| 3,410,975 | 11/1968 | Voland | 200/276.1 |
| 4,015,094 | 3/1977 | Gavagan et al. | 200/61.58 B |
| 4,169,974 | 10/1979 | Peers-Tarventon | 200/276.1 X |
| 4,488,018 | 12/1984 | Hayashida | 200/276.1 X |
| 4,698,465 | 10/1987 | Oba | 200/16 F |

FOREIGN PATENT DOCUMENTS

| | | | |
|---|---|---|---|
| 6-60755 | 3/1994 | Japan | H01H 1/06 |

*Primary Examiner*—J. R. Scott

*Attorney, Agent, or Firm*—Nikaido, Marmelstein, Murray & Oram LLP

[57] ABSTRACT

A miniature pushbutton switch capable of being made compact as well as being given a sufficient contacting pressure for reliable switch operation. The switch comprises a housing with first and second contacts, and an electrically conductive torsion coil spring composed of a coil portion and a pair of first and second arms integrally extending therefrom. The coil spring is assembled in the housing with the first arm constantly engaged electrically with the first contact and with the second contact in engageable relation with the second contact. A pushbutton is supported by the housing to be movable between an inoperative position and an operative position respectively of breaking and making the electrical connection between the second arm and the second contact. The first and second arms extend in opposite directions from the coil portion. The pushbutton is held in direct engagement with the coil portion to displace it when the pushbutton is pushed to the operative position, whereby the second arms is caused to resiliently deform to make or break the electrical connection with the second contact. As the coil portion is displaced by a force applied from the pushbutton, the second arm as well as the first arm are resiliently deformed to thereby develop sufficient contacting pressures even at the beginning of engaging the second arm with the second contact. Consequently, the switch can be easily designed to have sufficient contacting pressures for reliable switch operation, even with the use of the coil spring of reduced axial length.

12 Claims, 5 Drawing Sheets

MINIATURE PUSHBUTTON SWITCH WITH COIL SPRING CONTACT

BACKGROUND OF THE INVENTION

1. Field of the Invention

The present invention is directed to a miniature pushbutton switch utilizing a coil spring as a movable contact for contact closing.

2. Description of the Prior Art

Japanese Laid-Open Publication No. 6-60755 discloses two types miniature pushbutton switches utilizing a torsion coil spring of electrically conductive material as a movable contact for contact closing. One type of the switches utilizes a coil spring having first and second arms extending from a coil portion of the coil spring. The coil spring is disposed with the first arm held in a constant electrical engagement with a first contact and with the second arm held in an engageable relation to a second contact. A pushbutton is connected to move the second arm into direct engagement with the second contact. With this configuration of directly displacing the second arm or applying a force of moving the second arm against the bias of the coil spring in order to make the electrical connection between the second arm and the second contact, the switch is difficult to give a sufficient contacting pressure at the very beginning of engaging the arm to the contact, which reduces reliable switching operation.

The other type of the switches is proposed to develop a desired contacting pressure by the use of an axially elongated coil spring. The coil spring is arranged to have one axial end thereof in a contact electrical engagement with a first contact and the other axial end in an engageable relation with a second contact. The pushbutton is connected to resiliently deform the coil spring along the axial length thereof for making the electrical connections with the second contact, thereby connecting the first and second contacts through the coil spring. Since this switch makes the use of the resilient deformation of the coil spring along the length thereof and therefore requires the coil spring of a relatively long axial length for contact closing, it is difficult to make the switch compact particularly with regard to a dimension between the first and second contacts.

SUMMARY OF THE INVENTION

In view of the above insufficiencies, the present invention has been accomplished to provide a miniature pushbutton switch which is capable of being made compact sufficient to be installed in a limited space and being given a sufficient contacting pressure for reliable switch operation. The miniature pushbutton switch in accordance with the present invention comprises a housing provided with a first contact and a second contact, and a torsion coil spring made of an electrically conductive material and composed of a coil portion and a pair of first and second arms integrally extending away from the coil portion. The coil spring is arranged in the housing with the first arm constantly engaged with the first contact for electrical connection therebetween and with the second contact in engageable relation with the second contact for making and breaking an electrical connection between the second arm and the second contact. A pushbutton is supported by the housing to be movable between an inoperative position and an operative position respectively of breaking and making the electrical connection between the second arm and the second contact. The pushbutton is engaged with the coil spring to resiliently deform said coil spring to thereby receive a counter bias from the coil spring when pushed to the operative position. The first and second arms extend in opposite directions from the coil portion. The pushbutton is held in direct engagement with the coil portion to displace the coil portion when the pushbutton is pushed to the operative position, whereby the second arm is caused to resiliently deform to make or break the electrical connection with the second contact. In this manner, as the coil portion is displaced by a force applied from the pushbutton, the second arm as well as the first arm are resiliently deformed to thereby develop sufficient contacting pressures at which the first and second arms are engaged respectively with the first and second contacts. Thus, it is made possible to engage the first and second arms with the associated contacts at sufficiently high contacting pressures even at the beginning of engaging the second arm with the second contact. Consequently, the switch can be easily designed to have sufficient contacting pressures for reliable switch operation, even with the use of the coil spring of reduced axial length.

Accordingly, it is a primary object of the present invention to provide a miniature pushbutton switch which is capable of assuring reliable switching operation as well as of being made compact.

The housing is provided with a stopper which is electrically insulated and spaced from the second contact for keeping the second arm engaged with the stopper when the pushbutton is in the inoperative position. As the pushbutton is pushed to displace the coil portion, the arm is caused to disengage from the stopper and come into contact with the second contact. With the provision of the stopper, the coil spring can be easily assembled with the first and second arms engaged with the first contact and the stopper, respectively, which is another object of the present invention.

Preferably, the second contact includes an inclined section which extends for intimate contact with the second arm deformed as a consequence of the coil portion displaced in response to the pushbutton being pushed to the operative position. The inclined section is advantageous to increase an area of contact between the second contact and the resiliently deformed second arm, and further to enable the second arm to slide along the inclined section as the second arm is resiliently deformed, thereby realizing a wiping effect of cleaning the contacting surfaces.

The pushbutton in the inoperative position is set to engage with the coil portion to displace the same for some extent in order to resiliently deform the first and second arms while keeping the first and second arms engaged respectively with the first contact and the stopper. Thus, the second arm is given a pre-tension so as to achieve a high contacting pressure as soon as the second arm comes into engagement to the second contact, in addition to that the first arm is kept engaged at a correspondingly high contacting pressure, thereby enhancing switching reliability.

The first arm includes a hook for locking engagement with a corresponding catch formed on the side of the housing adjacent the first contact, thereby making it easy to assembly the coil spring in the housing. The second arm includes a transverse bar extending at an angle from the end of the second arm for sliding engagement with said stopper. The second contact and the stopper are arranged along the length of the transverse bar, while the second contact is offset from the stopper in a direction along which the second arm deforms resiliently as the pushbutton is pushed. Thus, the second arm can be easily engaged with the stopper at the time of assembling the coil spring simply by sliding the transverse bar along the stopper, while the second arm can respond to move to the second contact as the second arm is resiliently deformed in response to the pushbutton being moved to the operative position.

The coil spring is designed to be of a symmetrical configuration having the first and second transverse bars projecting in the opposite directions. The first transverse bar projects from the first arm to define the hook for locking engagement with the catch, while the second transverse bar projects from the second arm for sliding engagement with the stopper. Thus, the coil spring can be easily assembled into the housing without paying an attention to the orientation of the coil spring.

Further, the pushbutton is formed with a first edge in abutment with the coil portion when the pushbutton is in the inoperative position, and is also formed with a second edge which is continuous from the first edge and is recessed with respect to the first edge so as to comes into abutment with the coil portion when said pushbutton is pushed towards the operative position. With the provision of thus recessed second edge, the pushbutton travels an extended stroke before making the electrical connection between the second arm and the second contact, thereby realizing the extended stroke of the pushbutton without requiring to increase the operating load so much.

The pushbutton is shaped into a thin plate having generally flat opposed side surfaces and is received in a slot between opposite side walls of the housing. The pushbutton is formed partly on the flat side surfaces with flanges projecting towards the side walls of the housing for closing the slot and therefore preventing an entry of foreign matter in the housing. Further, the pushbutton may be formed on the side surfaces with guide ribs which project for sliding engagement with the side walls of the housing, thereby achieving smooth movement of the pushbutton between the operative and inoperative positions.

These and still other objects and advantageous features will become more apparent from the following detailed description of the invention when taken in conjunction with the attached drawings.

DETAILED DESCRIPTION OF THE EMBODIMENT

Figure 1:
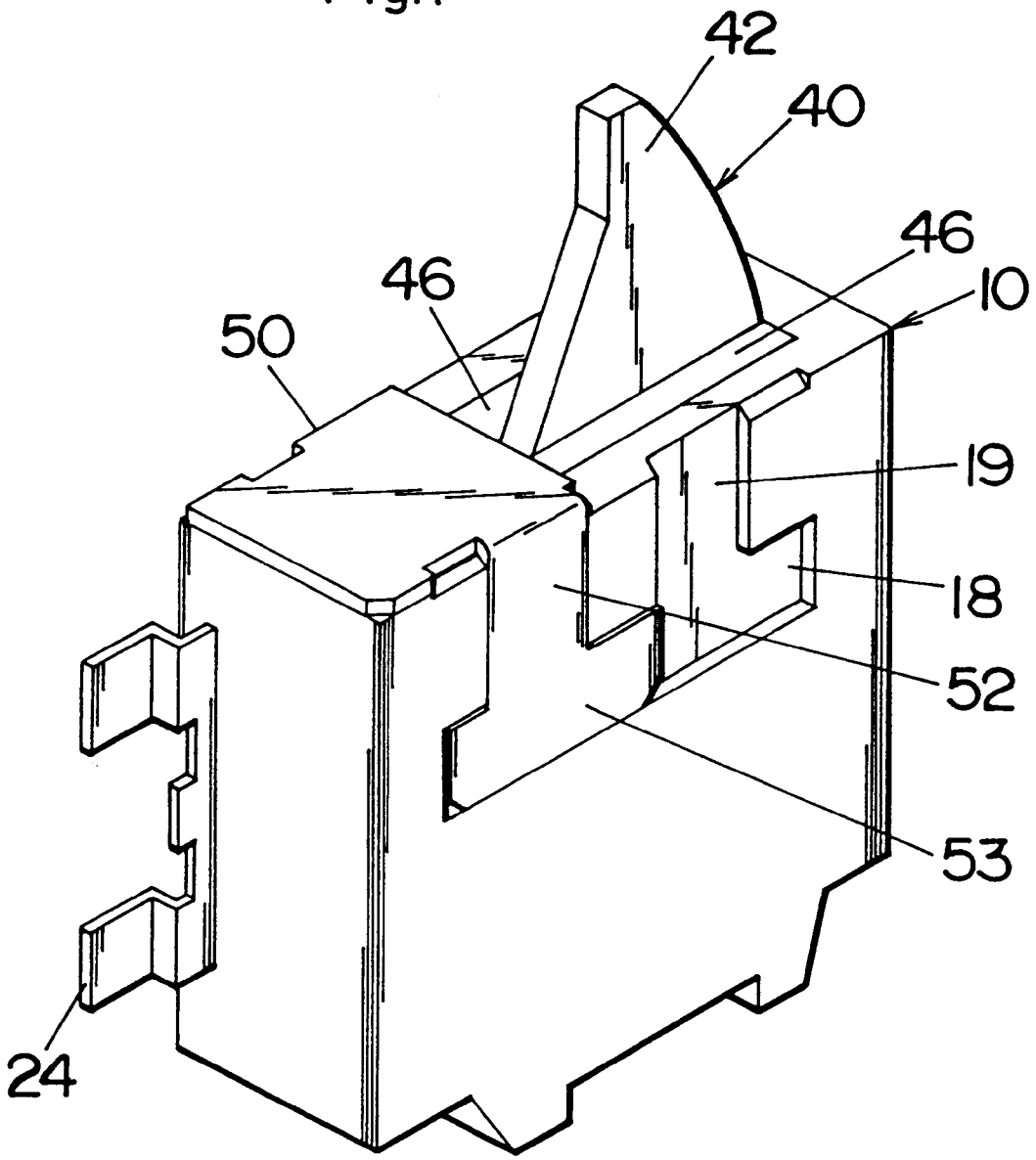
FIG. 1 is a perspective view of a pushbutton switch in accordance with a preferred embodiment of the present invention.

Referring now to FIGS. 1 to 4, there is shown a miniature pushbutton switch in accordance with a preferred embodiment of the present invention. The switch is utilized, for example, as a detection switch in a floppy disk drive for detection of the presence of the floppy disk in the disk drive. The switch comprises a thin generally rectangular housing 10 made of electrically insulating plastic material to have a top opened slot 11. Mounted on the interior bottom of the housing 10 are a set of a first contact 21 and a second contact 22 which are spaced along a length of the housing and are formed respectively with a first terminal 23 and a second terminal 24 projecting outwardly of the housing 10 for connection with an external electric circuit. A torsion coil spring 30 of an electrically conductive material is held in the housing 10 as a movable contact for making and breaking an electrical connection between the first and second contacts 21 and 22. The coil spring 30 is engaged with a pushbutton 40 to be driven thereby for making the electrical connection.

Figure 3:
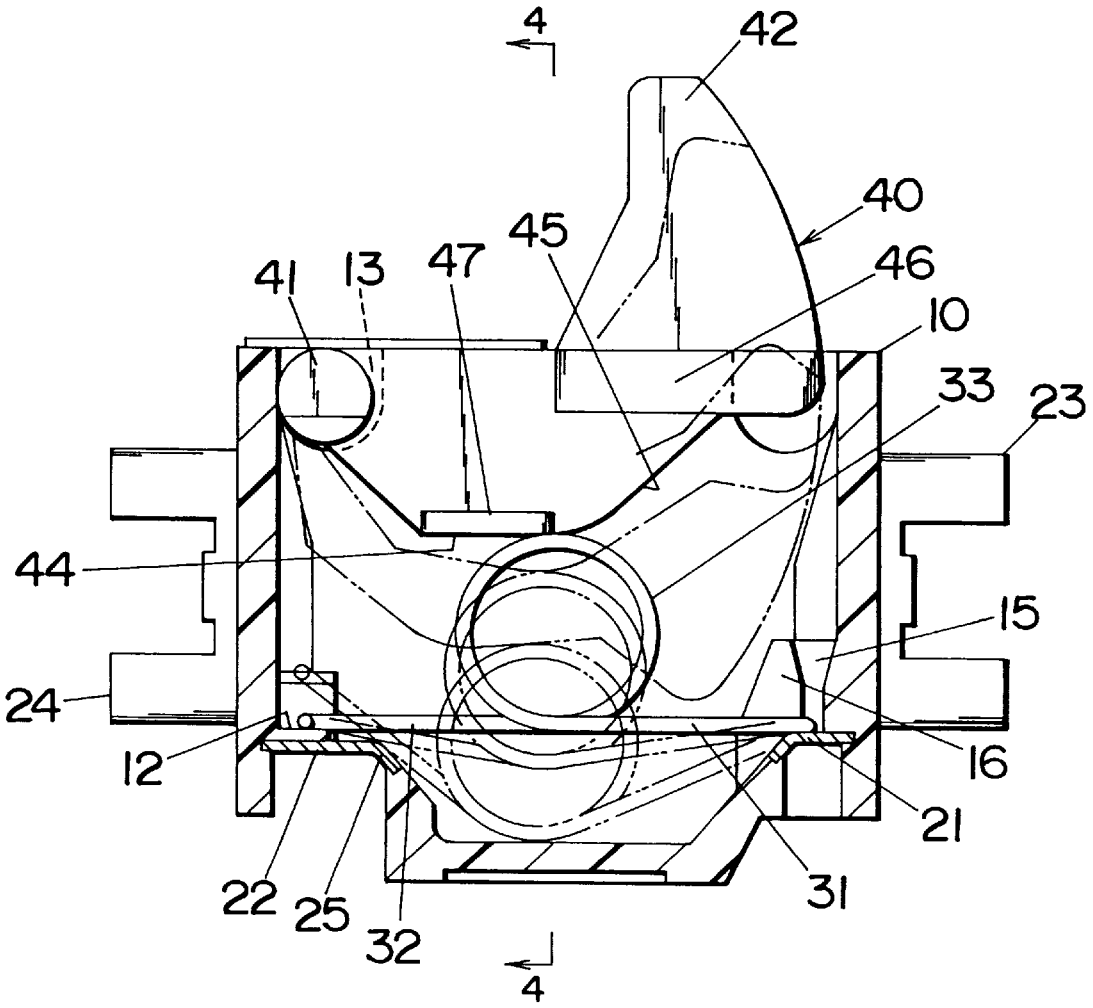
FIG. 3 is a sectional view taken along line 3—3 of FIG. 2.
Figure 4:
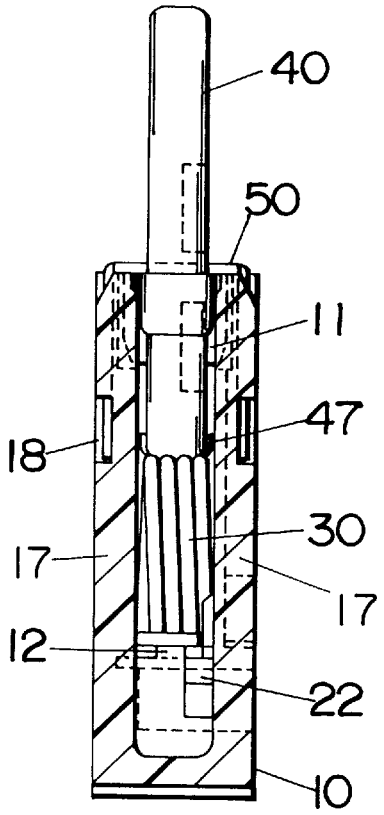
FIG. 4 is a sectional view taken along line 4—4 of FIG. 3.
Figure 6:
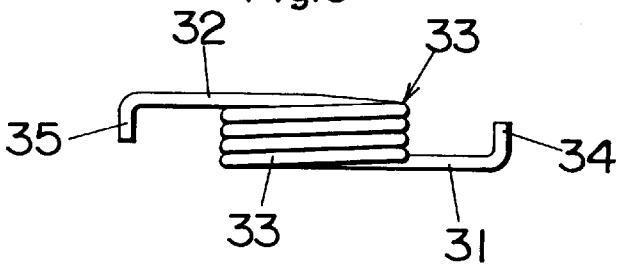
FIG. 6 is a top view of the coil spring.
Figure 5:
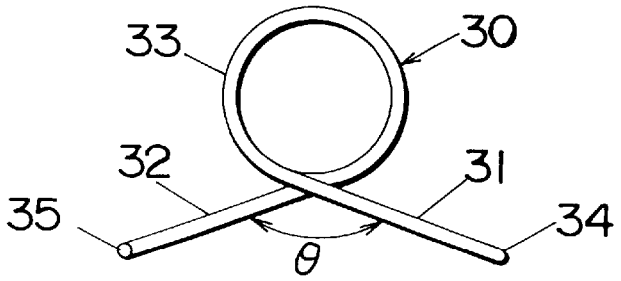
FIG. 5 is a front view of a torsion coil spring utilized in the above switch.

As shown in FIGS. 5 and 6, the coil spring 30 comprises a coil portion 33 and a pair of first and second arms 41 and 42 extending from the coil portion 33 in a generally opposite directions at an angle θ of less than 180°. The free ends of the first and second arms are bent at a right angle to define thereat first and second transverse bars 34 and 35, respectively. As shown in FIG. 3, the coil spring 30 is disposed in the housing 10 with the first and second arms 31 and 32 engaged respectively on the first contact 21 and on a stopper 12 formed immediately above the second contact 22. The pushbutton 40 is shaped into a flat configuration so as to fit loosely in the slot 11 of the housing 10, and is pivotally supported to the housing 10 by means of a pivot pin 41 formed at one end of the button 40. The pivot pin 41 has its axially opposite ends held in corresponding rounded holes 13 formed in inner surfaces of side walls of the housing 10 so that the pushbutton 40 pivots to move between an inoperative position where a handle 42 of the pushbutton project upwardly of the housing, as indicated by solid lines in FIG. 3, and an operative or depressed position where the handle 42 is pushed in the housing 10, as indicated by dotted lines in the figure.

A fixture cover 50 is secured to the housing 10 to retain the pushbutton 40 in the inoperative position against the bias of the coil spring 30. The lower end of the pushbutton 40 is contoured to have a generally flat first edge 44 and a second edge 45 continuous from and recessed with respect to the first edge 44. When the pushbutton 40 is inoperative position, the first edge 44 is kept in abutment with the coil portion 33 so as to keep the coil spring 30 deformed to some extend such that the coil portion 33 is displaced downwards by a short distance to resiliently deform the first and second arms 31 and 32, as indicated by the solid lines in FIG. 3, from the original configuration as shown in FIG. 5. As a result of this, the pushbutton 40 receives an upward bias from the coil spring 30 but is held in the inoperative position by means of the fixture cover 50. Further, since the coil spring 30 is resiliently deformed even in the inoperative position, the first and second arms 31 and 32 are pretensioned so as to be kept pressed against the first contact and the stopper 12 at correspondingly developed contacting pressures. As the pushbutton 40 is pushed into the operative position, the coil portion 33 is further displaced downwards to resiliently deform the first and second arms 31 and 32 to such a greater extend that the second arms 32 is disengaged from the stopper 12 and comes into pressed engagement with the second contact 22, thereby making the electrical connection between the first and second contacts through the coil spring 30. In this manner, the contact closing is made only after the first and second arms 31 and 32 resiliently deforming in a relatively large amount, a resulting restoring force of the coil spring 30 gives a correspondingly high contacting pressure. Therefore, the switch can be operated to close the contacts at a high operating a contacting pressure. After removal of the force applied to the pushbutton 40, the coil spring 30 restores its original shape to break the electrical contact at the second arm, while moving back the pushbutton 40 in the inoperative position.

Figure 9:
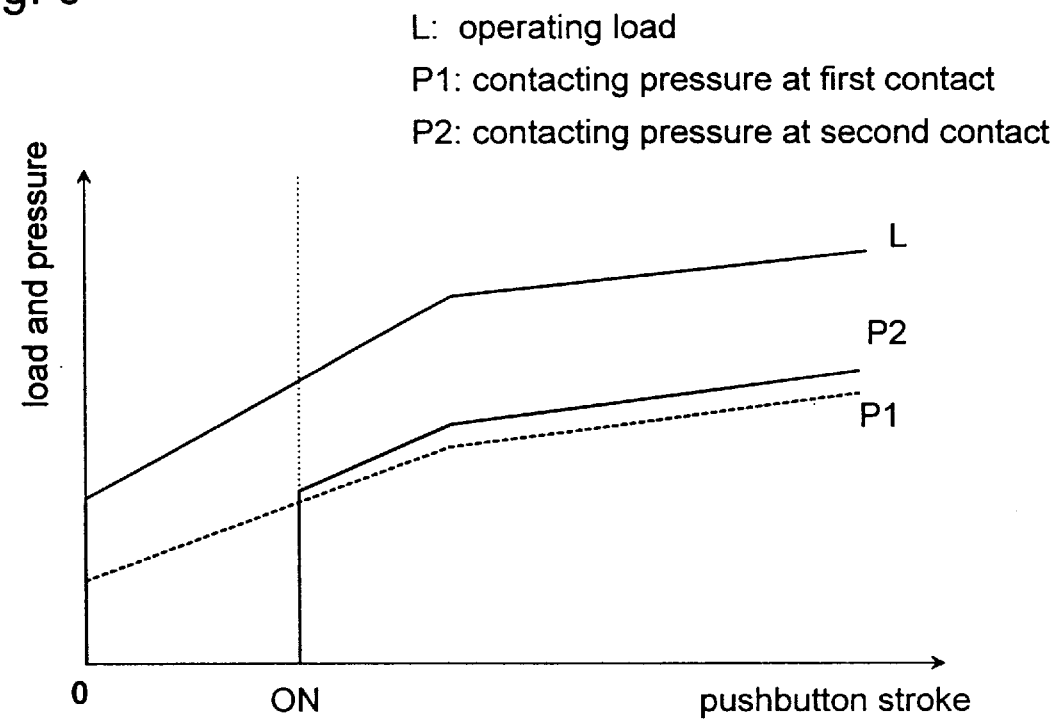
FIG. 9 is a graph illustrating operation characteristics of the switch.

It should be noted here that, since the second arm 32 is pre-tensioned when the pushbutton 40 is in the inoperative position, the second arm 32 will be pressed against the second contact 22 at a higher contacting pressure P2 than otherwise, as soon as the second arm 32 comes into engagement with the second contact 22 in response to the pushbutton 40 being pushed towards the operative position, as shown in FIG. 9. Also, at this time, the first arm 31 is pressed against the first contact at a correspondingly high contacting pressure P1 to make the electrical connection between the first and second contact at the sufficient contacting pressures P1 and P2 for reliable switch operation.

Figure 8:
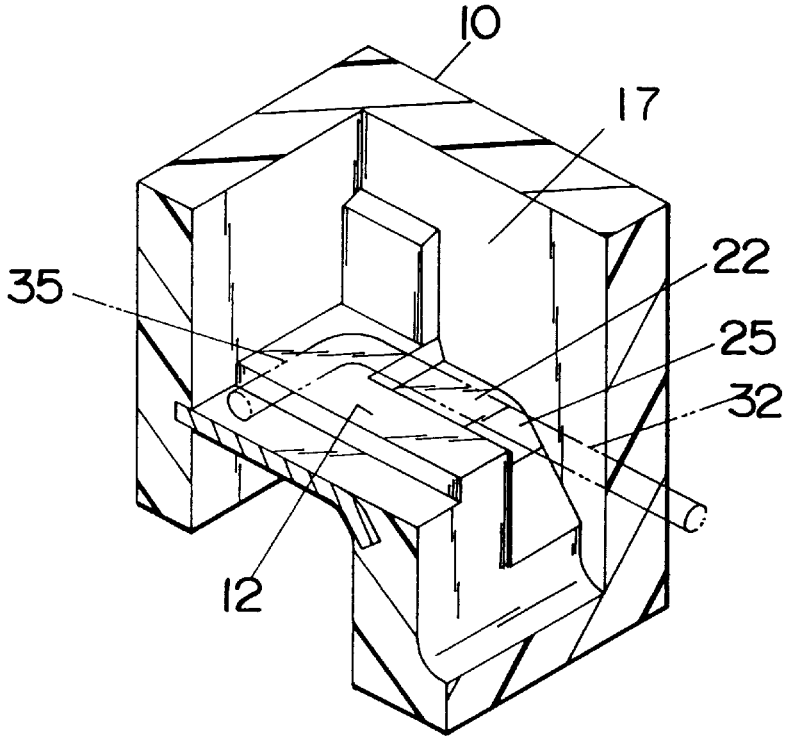

As shown in FIGS. 3 and 8, the second contact 22 is formed at its inner end with an inclined section 25 against which the second arm 32 is pressed to make the electrical connection therebetween. The inclined section extends in conformity with the second arm 32 being resiliently deformed in response to the pushbutton 40 being pushed to the operative position. Thus, the second arm 23 is caused to slide along the inclined section 25 as it it resiliently deformed, thereby giving a wiping effect of cleaning the second contact 22.

During the pivotal movement of the pushbutton about the pivot pin 41 from the inoperative position towards the operative position, the first edge 44 of the pushbutton 40 comes firstly in abutment with the coil portion 33 and then the recessed second edge 45 comes into abutment with the coil portion 33 instead such that the coil portion 33 is displaced at a low rate in relation to a stroke of the pushbutton 40. With this result, the pushbutton 40 is given a long stroke, i.e., a travel distance until the second arm 32 is finally electrically connected to the second contact 22. Thus, the switch can have a long travel distance even within a limited height dimension. As is shown in FIG. 9, the first and second arms 31 and 32 are caused to deform continuously so as to increase the contacting pressures P1 and P2 at the first and second contacts 21 and 22 as the interface of the coil portion 33 with the pushbutton 40 moves from the first edge 44 to the second edge 45 as well as along the second edge 45.

Figure 7:
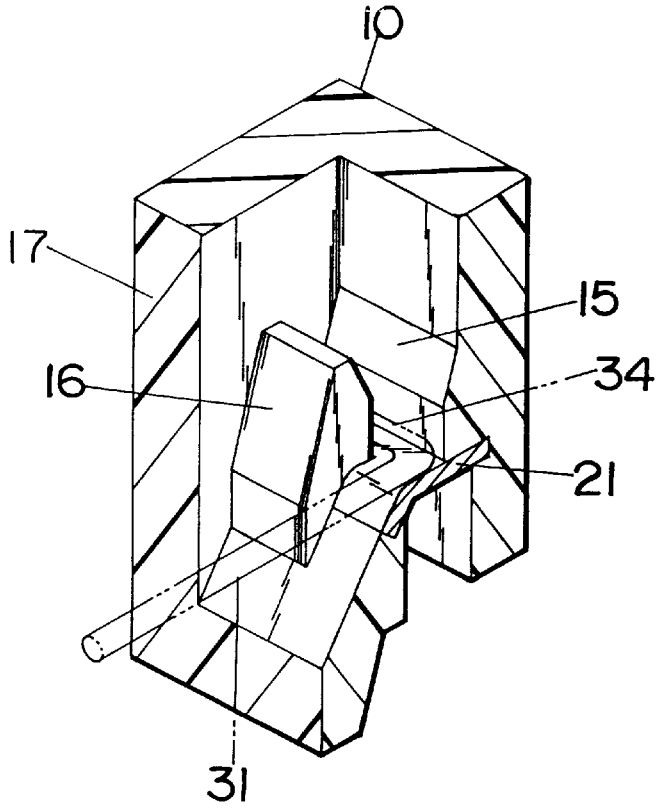
FIGS. 7 and 8 are perspective views respectively illustrating positions where the coil spring is engaged at opposite arms to a housing of the switch.

As shown in FIGS. 3 and 7, the first arm 32 is kept engaged with the second contact 22 by engaging the first transverse bar 34 into a top-open vertical slit 15 which is formed between a stud 16 projecting integrally from the bottom of the housing 10 and an inner end wall of the housing 10 and terminates at its bottom to the second contact 22. In this sense, the first transverse bar 34 may be termed as a hook for easy locking engagement of the first arm 31 to the second contact 22. On the other hand, the second arm 32 is held in position with the second transverse bar 35 placed simply on the stopper 12 when the coil spring 30 is assembled into the inoperative position, as shown in FIG. 3 and 8. The stopper 12 is integrally formed with the housing 10 to extend along the length of the second arm 32 in laterally and vertically spaced relations to the second contact 22, as best shown in FIG. 8. Thus, the second transverse bar 35 can be readily guided along the stopper 12 when the coil spring 30 is assembled by being deformed from the original shape of FIG. 5 to the initial shape as indicated by the solid line of FIG. 3, whereby facilitating the assembly of the coil spring, in addition to the first arm 31 being easily hooked by the first transverse bar 34. By engagement of the second transverse bar 34 on the stopper 12, the second arm 32 are held immediately but spaced above the second contact 22 so as to be ready to be pressed against the second contact 22 as the second arm 32 is caused to resiliently deformed in response to the operation of the pushbutton 40. Further, because of the symmetrical configuration, the coil spring 30 can be readily assembled.

Figure 2:
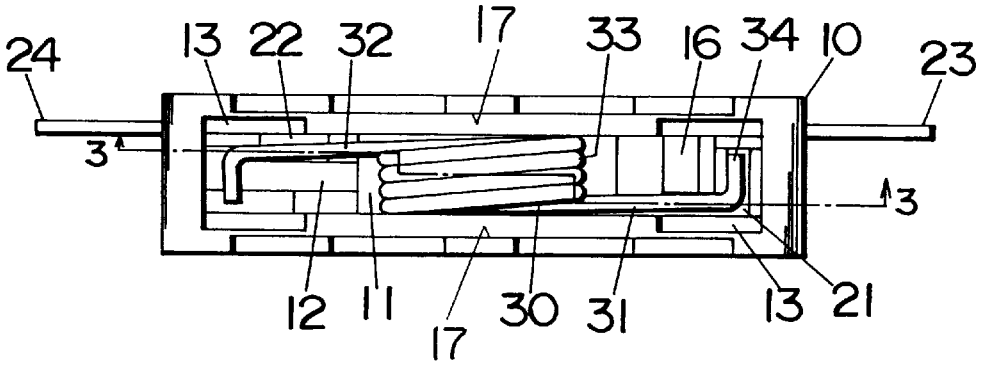
FIG. 2 is a top view of the pushbutton switch shown with a top cover and a pushbutton being removed therefrom.

As shown in FIGS. 2 and 3, the housing 10 is of mirror image construction with regard to the holes 13 for receiving the pivot pin 41, the pushbutton 40 can be assembled to the housing with the handle 42 projecting selectively on either right and left end of the housing 10. In order to make the selective disposition of the pushbutton 40, the fixture cover 50 is also arranged to be secured selectively to either of left an right ends of the housing 10. For this purpose, the housing 10 is formed in its outer surface of the opposite side walls with horizontal grooves 18 each having a pair of spaced vertical notches 19, as shown in FIG. 1. The fixture cover 50 is formed to have a top plate 51 which is placed over a portion of the pushbutton 40 to hold the pushbutton in the inoperative position against the bias of the coil spring 30. Depending from the lateral ends of the top plate 51 are a pair of legs 52 which are selectively fit into either right or left vertical notches 19. The legs is formed at its lower end with anchor tabs 53 which are pressed into right or left portion of the horizontal grooves 18 for securing the fixture cover 50 to the desired position.

The pushbutton 40 is formed on its opposite surfaces with a pair of flanges 46 which project towards the side walls of the housing 30, closing the top opening of the slot 11 not covered by the top plate 51 of the cover 50 for preventing an entry of the foreign matters. The pushbutton 40 is also formed on its opposite surfaces adjacent the first edge 44 with a pair of guide ribs 47 which project towards the inner side walls of the housing 10 in a slidable relation thereto. Thus, the guide ribs 47 acts to guide the pushbutton 40 smoothly to the operative position even when the pushbutton 40 is pushed rather obliquely.

The present invention is not limited to the above embodiment and may include following modifications.

Figure 10:
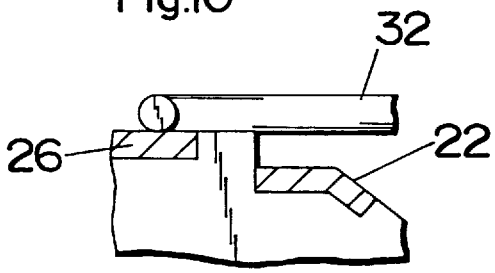
FIGS. 10 and 11 are schematic views illustrating modifications of the above embodiment.

FIG. 10 illustrates one such modification of the switch which is identical to the above switch except for the addition of a third contact 26. The third contact 26 is positioned immediately upward of the second contact 22 and offset therefrom so that the third contact 26 is in constant electrical engagement with the second arm 32 in the inoperative position. As the second arm 32 is caused to deform resiliently in response to the pushbutton being pushed, the second arm 32 is disengaged from the third contact and comes into electrical engagement with the second contact 22, thereby breaking the electrical connection at the third contact 26 and making the electrical connection at the second contact 22. The third contact 26 may be separately formed from the above stopper or may take the form of the stopper of the above embodiment.

Figure 11:
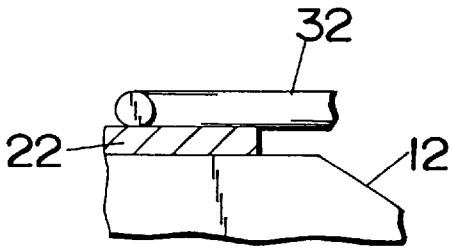

FIG. 11 illustrates the other modification which is identical to the above embodiment except that the second contact 22 is arranged to be in constant electrical connection with the second arm 32 in the inoperative position and be disengaged from the second arm 32 when the second arm is pushed to the operative position. For this purpose, the second contact 22 is located immediately upwardly of the stopper 12 against which the second arm 32 is engaged when resiliently deformed in response to the pushbutton being pushed to the operative position. In any of the above modifications, the second arm is pre-tensioned to give a sufficient contacting pressure with the third contact or the second contact at the inoperative position of the pushbutton.

What is claimed is:

1. A pushbutton switch comprising:

a housing provided with a first contact and a second contact; a torsion coil spring made of an electrically conductive material and comprising a coil portion and a pair of first and second arms integrally extending away from said coil portion, said coil portion having a coil axis, said coil spring being disposed in said housing with said first arm engaged with said first contact for constant electrical connection therebetween and with said second contact in engageable relation with said second contact for making and breaking an electrical connection between the second arm and the second contact;

a pushbutton supported by said housing to be movable between an inoperative position and an operative position for selectively breaking and making the electrical connection between the second arm and said second contact, said push button engaged with said coil spring to resiliently deform said coil spring to thereby receive a counter bias from said coil spring when pushed to said operative position; wherein said first and second arms extend in opposite directions and said pushbutton directly engages said coil portion to displace said coil portion in a direction perpendicular to said coil axis when said pushbutton is pushed to said operative position, whereby said second arm is caused to resiliently deform to make or break the electrical connection with said second contact.

2. The pushbutton switch as set forth in claim 1, wherein said housing is provided with a stopper which is electrically insulated and spaced from said second contact for keeping said second arm engaged with said stopper when said pushbutton is in said inoperative position, said second arm being caused to come into contact with said second contact when said pushbutton is pushed to said operative position.

3. The pushbutton switch as set forth in claim 1, wherein said second contact includes an inclined section which extends for sliding contact with said second arm deformed as a consequence of said coil portion displaced in correspondence with the movement of said pushbutton to said operative position.

4. The pushbutton switch as set forth in claim 2, wherein said pushbutton in said inoperative position engages with said coil portion to displace the same for some extent in order to resiliently deform said first and second arms while keeping said first and second arms engaged respectively with said first contact and said stopper.

5. The pushbutton switch as set forth in claim 2, wherein said first arm has a hook for locking engagement with a corresponding catch formed on the side of the housing adjacent said first contact.

6. The pushbutton switch as set forth in claim 2, wherein said second arm further includes a transverse bar extending at an angle from the end of the second arm for sliding engagement with said stopper, said second contact and said stopper being arranged along the length of said transverse bar and said second contact being offset from said stopper in a direction along which said second arm deforms resiliently in response to said displacement of said coil portion.

7. The pushbutton switch as set forth in claim 2, wherein said first arm has a hook in the form of a first transverse bar extending at an angle from the end of said first arm for locking engagement with a corresponding catch formed on the side of the housing adjacent said first contact, and wherein said second arm further includes a second transverse bar extending at an angle from the end of the second arm for sliding engagement with said stopper, said second contact and said stopper being arranged along the length of said second transverse bar, and said second contact being offset from said stopper in a direction along which said second arm deforms resiliently in response to said displacement of said coil portion, said coil spring being of a symmetrical configuration to have said first and second transverse bars projecting in the opposite directions.

8. The pushbutton switch as set forth in claim 1, wherein said pushbutton is formed with a first edge in abutment with said coil portion when said pushbutton is in said inoperative position, said pushbutton being further formed with a second edge which is continuous from said first edge and is recessed with respect to said first edge so as to come into abutment with said coil portion when said pushbutton is pushed towards said operative position.

9. The pushbutton switch as set forth in claim 1, wherein said pushbutton is in the form of a thin plate having generally flat opposed side surfaces and is received in a slot between opposite side walls of said housing, said pushbutton being formed partly on said flat side surfaces with flanges projecting towards said side walls of said housing for closing said slot.

10. The pushbutton switch as set forth in claim 9, wherein said pushbutton is formed on said side surfaces with guide ribs which project for sliding engagement with said side walls of said housing.

11. The pushbutton switch as set forth in claim 1, further including a third contact which is positioned in a closely spaced relation with said second contact so as to be constantly engaged with said second arm when said pushbutton is in said inoperative position, said second contact being offset from said third contact so that said second arm is resiliently deformed, in response to the movement of the pushbutton from said inoperative position to said operative position, to come into electrical contact with said second contact after being disengaged from said third contact.

12. The pushbutton switch as set forth in claim 1, wherein said second contact is arranged to be kept in electrical contact with said second arm when said pushbutton is in said inoperative position, and wherein said housing is provided with a stopper which is electrically insulated and spaced from said second contact so that said second arm is resiliently deformed, in response to the movement of the pushbutton from said inoperative position to said operative position, to come into engagement with said stopper after being disengaged from said second contact.

* * * * *